US005495634A

United States Patent [19]

Brundula et al.

[11] Patent Number: 5,495,634

[45] Date of Patent: Mar. 5, 1996

[54] VACUUM SWEEPER ROLLER BRUSH

[75] Inventors: Rudolph F. Brundula, Gates Mills; William P. Brundula, Kirtland, both of Ohio

[73] Assignee: Bruns Brush Inc. (Ohio Corporation), Willoughby, Ohio

[21] Appl. No.: 270,721

[22] Filed: Jun. 30, 1994

[51] Int. Cl.[6] ..... A47L 5/30

[52] U.S. Cl. ..... 15/182; 15/179; 15/366

[58] Field of Search ..... 15/179, 182, 41.1, 15/42, 48, 49.1, 5, 383, 384, 366

[56] References Cited

U.S. PATENT DOCUMENTS

| | | | |
|---|---|---|---|
| 1,355,978 | 10/1920 | Jackson | 15/383 X |
| 1,886,129 | 11/1932 | Smellie . | |
| 1,889,224 | 11/1932 | Smellie . | |
| 2,045,270 | 6/1936 | Hoover . | |
| 2,271,551 | 2/1942 | Hoover | 15/366 |
| 2,512,544 | 6/1950 | Hammell | 15/366 |
| 2,659,921 | 11/1953 | Osborn . | |
| 3,139,641 | 7/1964 | Grogan et al. . | |
| 3,541,628 | 11/1970 | Girard . | |
| 3,564,637 | 2/1971 | Gollish . | |
| 3,597,789 | 8/1971 | Boyd | 15/383 |
| 4,177,536 | 12/1979 | Powers | 15/366 |
| 4,349,936 | 9/1982 | Lorson | 15/5 |
| 4,372,004 | 2/1983 | Vermillion | 15/366 |
| 4,429,430 | 2/1984 | Lyman . | |
| 4,912,805 | 4/1990 | Krasznai et al. | 15/366 |
| 4,955,102 | 9/1990 | Cousins | 15/383 |
| 5,003,663 | 4/1991 | Sunagawa et al. | 15/366 |

FOREIGN PATENT DOCUMENTS

| | | | |
|---|---|---|---|
| 1025303 | 1/1953 | France | 15/179 |

*Primary Examiner*—Edward L. Roberts, Jr.
*Attorney, Agent, or Firm*—Woodling, Krost & Rust

[57] ABSTRACT

The invention is directed toward a vacuum sweeper roller brush having an integrally formed stiffener bar. The roller brush includes a plurality of brush tufts which fixedly reside in recesses. The brush tufts and stiffener bars are arranged helically on the exterior of a generally cylindrical roller member. The stiffener bars support the brush tufts to provide improved sweeping performance.

6 Claims, 3 Drawing Sheets

VACUUM SWEEPER ROLLER BRUSH

Field of the Invention

The present invention relates in general to roller brushes for vacuum sweepers and more particularly to such brushes which have a stiffener bar molded integrally with the brush roller so as to provide support for brush tufts mounted on the roller as they engage a surface being swept.

DESCRIPTION OF RELATED ART

Roller brushes for vacuum sweepers typically include brush tufts arranged in helical patterns on the surface of the rollers. In many cases the brush tufts are mounted on a strip which is inserted into a slot or groove on the roller surface.

The related art also discloses so-called beater bars which may also be referred to as stiffener bars located behind the brush tufts so as to support the tufts as they engage a carpet or other surface to be swept. In these devices as known to applicant these constructions are always carried on a strip or the like which is inserted into a groove or slot on the surface of the roller. These constructions are shown in U.S. Pat. Nos. 4,177,536; 4,372,004 and 4,955,102. These constructions have the problem that when the bristle tuft pattern on the surface is changed radically from one angle to another angle it is not possible and/or economical to produce a slot to accommodate the angular change.

SUMMARY OF THE INVENTION

The present invention provides a structure which obviates the problem with the related art discussed above. The structure of the present invention includes a cylindrical mounting member, also known as a roller, preferably constructed of a molded material. The molded roller material may be polypropylene, ABS, styrene, etc. The roller materials may or may not include a talc which increases the heat resistance of the material. The roller might be formed of other suitable and satisfactory polymeric materials known to those skilled in the art. The molded roller materials have uniform density which minimize vibration and provide smoother operation.

The mounting member or roller is provided with a plurality of circumferentially spaced and helically extending stiffener bars which have been integrally formed on the exterior surface of the mounting member in the molding thereof. These stiffener bars extend generally from one end to the other end of the mounting member. The mounting member of course is adapted to be mounted in the appropriate position in a conventional electric vacuum sweeper and is adapted to be rotationally driven in a given direction.

A plurality of spaced and drilled brush tuft receiving openings are provided in the mounting member closely in front of the stiffener bars in relation to the rotational direction referred to and these extend generally coextensive with the stiffener bars. It is possible to provide the tuft receiving openings in a manner other than by drilling. However, regardless of the method of producing the openings, they do receive brush tufts which perform a sweeping action and these brush tufts are appropriately secured in the openings in the preferred embodiment by means of staples. The brush tufts may also be secured by flat anchors.

The brush tufts are so arranged in respect to the stiffener bars that in operation when the roller member is rotated the brush tufts upon engaging the surface which is being swept are kept from bending over too far and tend to keep the brush tufts erect. As the brush tufts pass through the sweeping area the action of the stiffener bars in combination with the brush tufts tends to impart energy to the tufts and assist in the sweeping and brushing action. The particular advantage of the structure of the present invention is that the so-called stiffener bars are not attached to the surface of the brush roller as part of an insert that is inserted into a slot or groove in the surface of the roller but rather act as a one piece connection with the material from the which the mounting member of the roller is formed. The particular advantage of this construction is that the helical angle that a row of brushes on a roller are designed to follow can be changed radically from one angle to another angle. In the design of the so-called brush pattern, a roller surface is sometimes altered in a radical fashion and in the case of particularly radical alterations it is not possible to accommodate this change where the brushes and stiffener bars are carried in a structure which is inserted into a groove or slot on the peripheral surface of the roller.

Another object of the present invention is to produce as much of a vacuum sweeper roller in a one-piece construction as is possible which gives rise to an extremely economical and low priced end product.

Another object of the present invention is to provide a vacuum sweeper brush roller construction wherein the stiffener bars are formed as an integral or one-piece construction or connection to the surface of the roller so that the end product is much more solid and reliable in its ultimate operation. Additionally, the molded roller material will have uniform density and low vibration.

Another object of the present invention is to provide a vacuum sweeper roller member which is of a unique and generally one-piece construction which is readily adapted to be connected rotatively at its opposed ends to bearing members and which is also provided with a unique thread guard.

DESCRIPTION OF THE DRAWINGS

In FIG. 2 the opposed brush tufts are illustrated at approximately 9 and 3 o'clock, the helical pattern of the brush tufts in FIG. 1 being 180°. In FIGS. 4 and 6 the opposed brush tufts are illustrated at approximately 12 and 6 o'clock.

Figure 2:
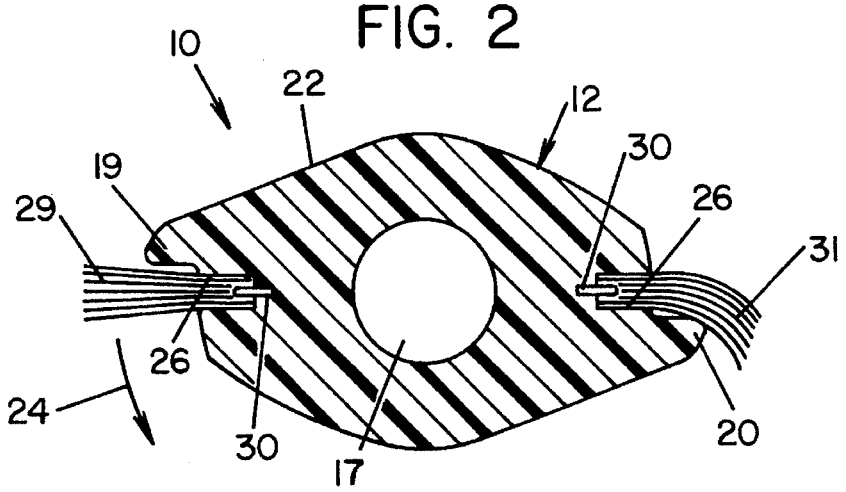
FIG. 2 is a cross-sectional view taken generally along the line 2—2 of FIG. 1 and illustrating the cross section of the roller brush shown in FIG. 1.

FIGS. 2, 4 and 6 each illustrate one of the brush tufts engaging a stiffener bar. In FIGS. 4 and 6, brush tufts located at 6 o'clock engage a carpet being swept. The carpet is not shown. In FIG. 2, however, one of the brush tufts at 3 o'clock is shown engaging the stiffener bar but that tuft would not be engaging the carpet. The tuft shown at 3 o'clock may or may not literally engage the stiffener bar in FIG. 2 depending on the degree the brush material snaps back to its original position. If stiff brush tufts are used, they will not engage the stiffener bar as shown at 3 o'clock in FIG. 2. Rather, they would appear similarly to those tufts shown at 9 o'clock in FIG. 2.

DESCRIPTION OF THE INVENTION

Figure 1:
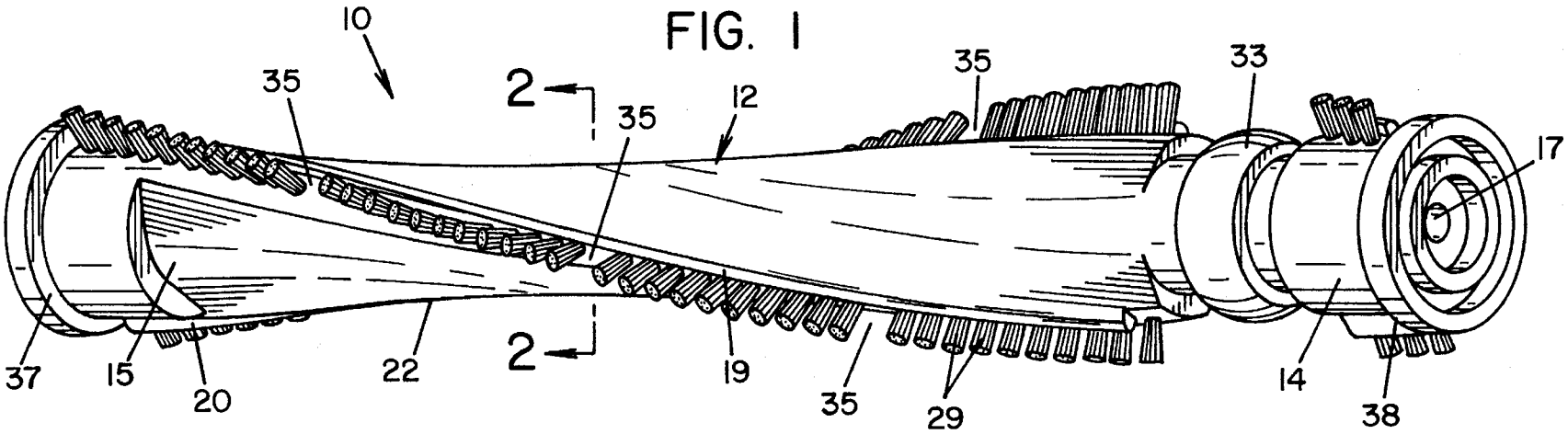
FIG. 1 is a perspective view of the vacuum sweeper roller brush of the present invention.

FIG. 1 illustrates the teachings of the present invention and illustrates in a perspective view the generally cylindrically shaped brush roller 10 for use in a conventional electric vacuum sweeper and this roller includes a generally cylindrical shaped mounting member 10 which is comprised of an integral molded plastic material and has first and second end portions 14 and 15, respectively. It will be seen that an opening 17 is formed completely through the member 12 from the first end to the second end portion thereof.

The mounting member 12 has integrally formed thereon first and second stiffener bars 19 and 20, respectively, and the stiffener bars of FIG. 1 extend in a helical pattern on the exterior surface 22 of the mounting member in a 180° helix. The length of the helix is measured from the first end portion to the second end portion of the mounting member. In other words, the brush pattern of FIG. 1 rotates 180° around the mounting member from the first end portion to the second end portion. It will be noted that the stiffener bars 19 and 20 are circumferentially spaced from each other and as noted above extend in a helical direction. The stiffener bars extend essentially from the first to the second end portions of the mounting member.

Ridges 37 and 38 are shown in FIG. 1 at the first and second end portions of the mounting member, respectively. The ridges 37 and 38 are thread guards to prevent hair and string and other foreign material and objects from entering and tangling about the points where the mounting member attaches to the vacuum sweeper.

The mounting member as it is mounted in an electric vacuum sweeper to perform its intended function is adapted to rotate in the direction indicated by the arrow 24. The mounting member can, however, be adapted to be driven in the opposite direction without departing from the spirit and scope of the invention.

A plurality of spaced and drilled brush tuft receiving openings 26 are provided in the exterior surface 22 of mounting member 12 and are located closely in front of the stiffener bars 19 and 20 in front of the stiffener bars in relation to the given rotational direction 24. These openings extend from the first to the second end portions of the mounting member and are preferably provided by a separate drilling operation. It is possible of course that the tuft receiving openings could be provided in a different mechanical way such as by providing an appropriate die to produce the openings in the injection molding process. Brush tufts 29 are provided in each of the openings 26 and are secured in position by means of staples 30. Flat anchors may also be used to secure the brush tufts.

The mounting member 12 is formed with a pulley portion 33 by reducing the surface of the mounting member 12 on either side thereof which is adapted to receive a driving belt from the electric motor of the vacuum sweeper in which the brush roller is ultimately installed. The opposite ends of the mounting member 12 in the embodiment illustrated in FIG. 1 have the same opening 17 as illustrated at the first end portion by the lead line 17 and the openings at either end of the mounting member are adapted to receive bearings for rotatably mounting the brush roller in the vacuum sweeper with which it is adapted to cooperate. The axial spaces between some of the brush tufts as illustrated in FIG. 1 at 35 for example are simply clearance areas to accommodate a tie bar when the brush roller is finally installed in the vacuum sweeper with which it is to cooperate.

In operation the brush roller 10 illustrated in FIG. 1 would be rotatably mounted in the suction nozzle area of a vacuum cleaner upon the bearings which have been referred to with a driving belt connected from the electric motor to the pulley 33 so as to rotatively drive the brush roller in a conventional fashion and in the direction illustrated arrow 24 in FIG. 2. The mounting and driving of the brush roller might be generally as illustrated in the U.S. Pat. No. 3,597,789 patented Aug. 10, 1971.

Figure 4:
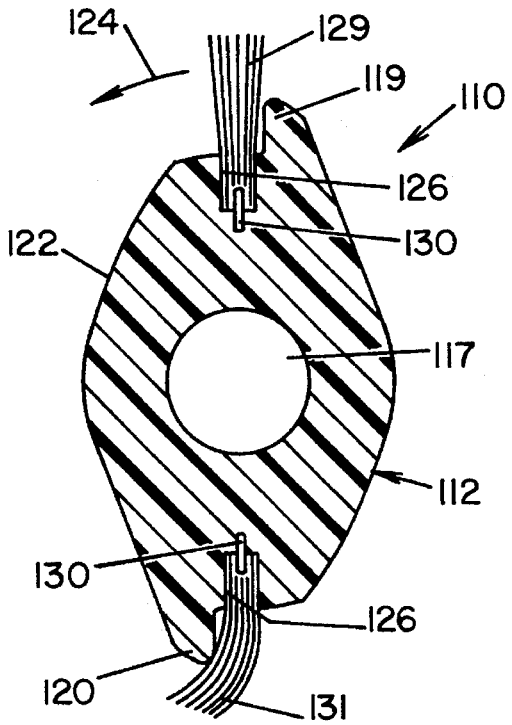
FIG. 4 is a cross section taken generally along the line 4—4 of FIG. 3.

The rotation of the brush roller causes the brush tufts to engage a carpet or other surface being cleaned and FIG. 4 illustrates a brush tuft 31 as engaging a surface such as a carpet and being bent slightly back into engagement with stiffener bar 20. The stiffener bar 20 tends to keep the brush tuft upright or vertical and as the brush roller takes the tuft illustrated by the reference numeral 31 out of engagement with the carpet it imparts a slight snapping or energy type action to the brush tuft to aid in the sweeping operation.

Figure 3:
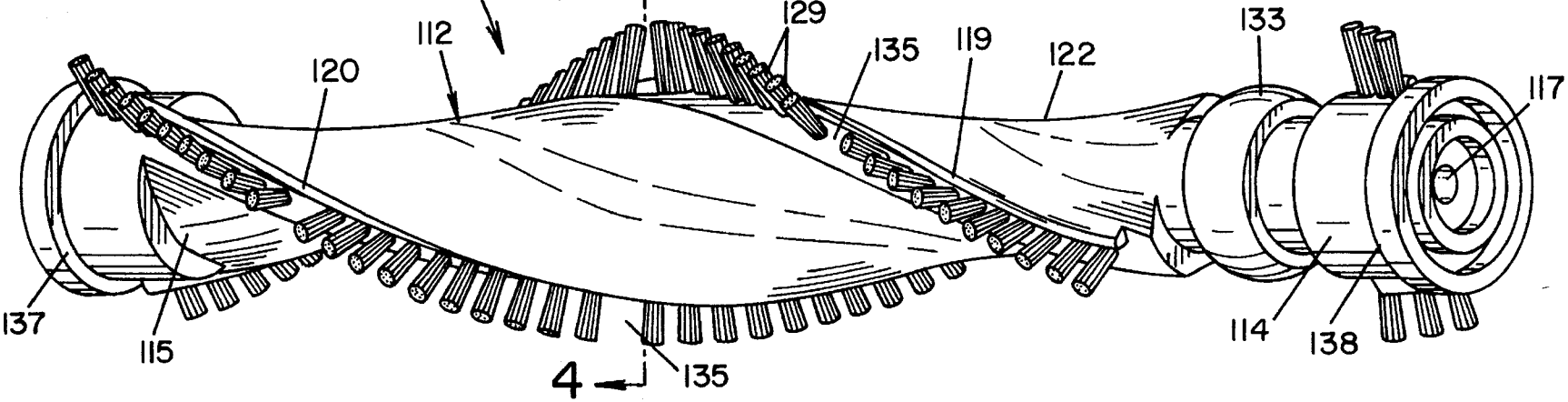
FIG. 3 is an isometric view of a slight variation of the showing of FIG. 1 in that the helical brush pattern and stiffener bar pattern extend helically at 360° as distinguished from 180° as illustrated in FIG. 1.

FIGS. 3 and 4 are quite similar to FIGS. 1 and 2 in their illustration, however FIG. 3 illustrates the stiffener bars and the brush tuft patterns as extending at a helical angle of 360°. Even though there is such similarity in the constructions applicant has identified the structural portions of FIGS. 3 and 4 with reference identifying numerals 100 digits higher than in FIGS. 1 and 2.

Figure 6:
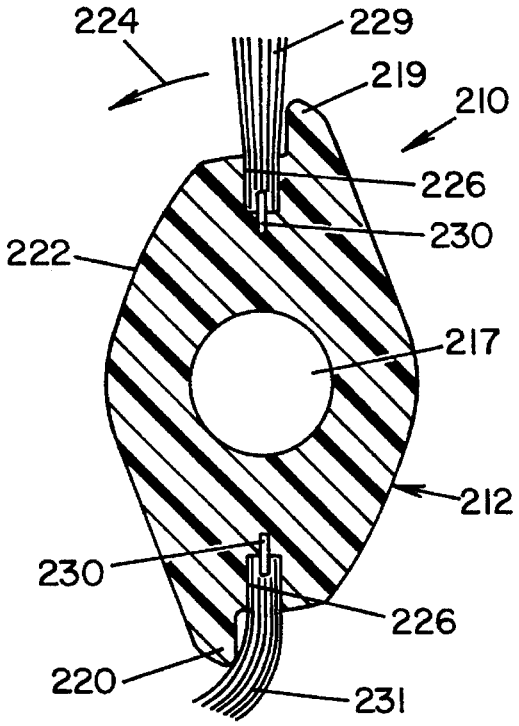
FIG. 6 is a cross-sectional view of taken generally along the line 6—6 of FIG. 5.
Figure 5:
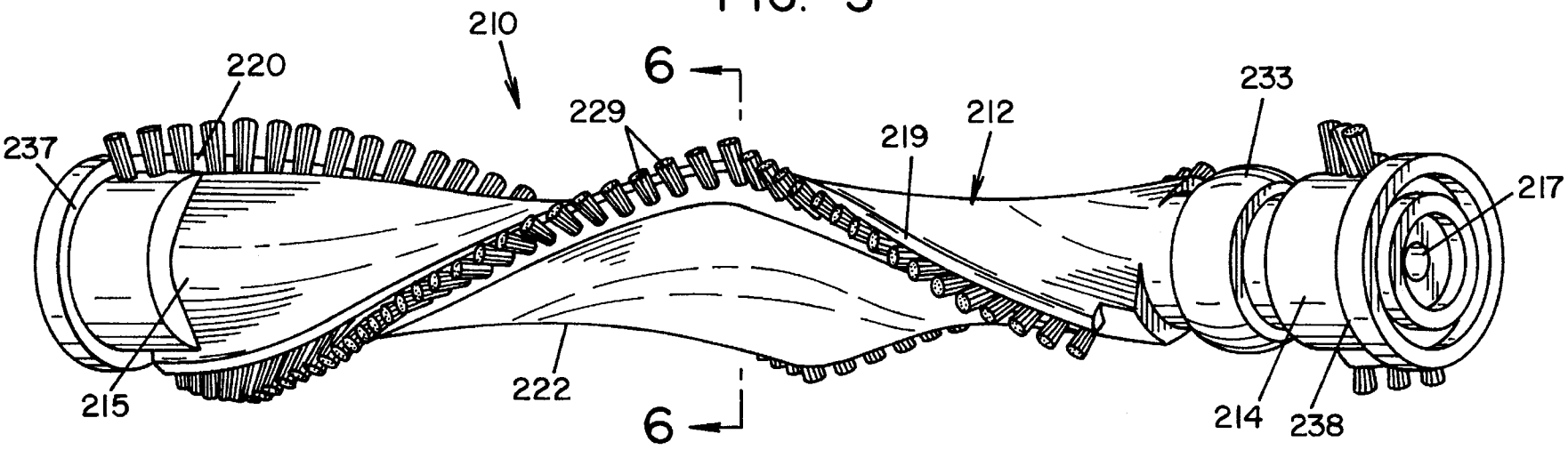
FIG. 5 is a view generally similar to FIGS. 1 and 3 but illustrating what is known in the art as a "chevron" pattern for the brush tufts of the sweeper roller.

FIGS. 5 and 6 show still a further helical pattern from that illustrated in the previous figures. The structure illustrated in FIGS. 5 and 6 is the same as the previous structures except for the pattern and corresponding structure has been indicated the same as in FIGS. 1 and 2, however with reference characters which are 200 digits higher. FIG. 5 illustrates a so-called "chevron" pattern of the brush tufts and the stiffener bars to enable those skilled in the art to better appreciate the invention. It will be noted in the construction of FIG. 5 that the brush tufts start from the right or first end portion of the mounting member in what may be referred to as a right hand helix and then approximately mid-way of the mounting member the helix pattern is radically or abruptly changed so that the pattern extends in a left hand helical direction.

Those skilled in the art will therefore appreciate the advantages of the present invention in they obviate the disadvantages of the prior art as discussed hereinabove. It will be particularly noted that in connection with FIG. 5 that when the helical angle of the brush tufts are abruptly or radically changed that it is extremely difficult to accommodate this change of pattern with stiffener bar patterns as discussed in connection with the related art and which are formed on an insert that is connected to the mounting by means of a slot or groove on the surface of the member.

Due to the fact that the stiffener bar construction of the present invention is integrally connected to the mounting member preferably in the manufacturing process that the pattern of the stiffener bars can be made quite easily and to extend in any particular direction.

The present invention is a one-piece construction except for the brush tufts and staples which hold the tufts in the openings. This provides a very economical construction to manufacture and also provides a reliable structure in that without a lot of separate parts it will have a longer than usual expected life.

The invention has been described in detail with particular emphasis on the preferred embodiments thereof, but it should be understood that variations and modifications within the spirit and scope of the invention may occur to those skilled in the art to which the invention pertains. For example, various other brush tuft and pattern bar patterns, helical and otherwise, may be employed in the present invention.

What is claimed is:

1. A generally cylindrical brush roller for use in a vacuum sweeper including in combination, a generally cylindrical shaped mounting member comprising an integral molded plastic material having first and second end portions, a plurality of circumferentially spaced and helically extending stiffener bars integrally formed on the exterior surface of said mounting member and extending generally from said first to said second end portions thereof, said mounting member adapted for rotation in a given direction, a plurality of spaced and drilled brush tuft receiving openings provided in said mounting member closely in front of said stiffener bars in relation to said given rotational direction and extending generally from said first to said second end portions, brush tufts in said brush tuft receiving openings, staples securing said brush tufts in said brush tuft receiving openings, said brush tufts adapted to engage said stiffener bars upon engaging a surface such as a carpet being swept which stiffener bars tend to keep said brush tufts erect and aid in the brushing action.

2. A vacuum sweeper brush comprising a roller member, said roller member including an integrally formed stiffener member extending along the length of said roller member on the exterior surface thereof, said roller member including a plurality of recesses in proximity to said stiffener member, a plurality of brush tufts, said brush tufts fixedly mounted in said recesses, whereby said stiffener member supports said brush tufts during engagement with a surface.

3. A vacuum sweeper brush comprising a cylindrically shaped roller having first and second end portions, a plurality of circumferentially spaced and helically extending stiffening ridges integrally formed on the exterior surface of said roller and extending generally from said first end portion to said second end portion of said roller, said brush adapted for rotation in a given direction, a plurality of brush tufts, brush tuft holding means securing said brush tufts to said roller, said brush tufts placed so as to engage said stiffening ridges when said brush tufts engage a surface being swept.

4. A vacuum sweeper brush as claimed in claim 2 further comprising thread guards.

5. A vacuum sweeper brush as claimed in claim 2 wherein said plurality of brush tufts and said stiffener bar are helically oriented about said roller member.

6. A vacuum sweeper brush as claimed in claim 5 further comprising multiple helical patterns of brush tufts and stiffener bars.

* * * * *